US007239295B2

(12) United States Patent
Kang et al.

(10) Patent No.: US 7,239,295 B2
(45) Date of Patent: Jul. 3, 2007

(54) METHOD AND APPARATUS FOR DRIVING PLASMA DISPLAY PANEL

(75) Inventors: Seong Ho Kang, Dasgu-shi (KR); Yong Duek Kim, Dasgu (KR); Ki Sang Hong, Pohang-shi (KR)

(73) Assignee: LG Electronics, Inc., Seoul (KR)

( * ) Notice: Subject to any disclaimer, the term of this patent is extended or adjusted under 35 U.S.C. 154(b) by 526 days.

(21) Appl. No.: 10/310,978

(22) Filed: Dec. 6, 2002

(65) Prior Publication Data

US 2003/0169217 A1 Sep. 11, 2003

(30) Foreign Application Priority Data

Dec. 8, 2001 (KR) ..... 10-2001-0077618

(51) Int. Cl.
*G09G 3/28* (2006.01)

(52) U.S. Cl. ..... 345/63; 345/68; 345/89; 345/77; 345/76; 345/690; 345/691

(58) Field of Classification Search ..... 345/63, 345/68, 89, 77, 76, 690–691
See application file for complete search history.

(56) References Cited

U.S. PATENT DOCUMENTS 5,757,343 A * 5/1998 Nagakubo ..... 345/63
6,388,678 B1 * 5/2002 Kasahara et al. ..... 345/690
6,597,333 B2 * 7/2003 Todoroki et al. ..... 345/63
6,831,618 B1 * 12/2004 Suzuki et al. ..... 345/60

FOREIGN PATENT DOCUMENTS

| | | | |
|---|---|---|---|
| JP | 6-259034 | | 9/1994 |
| JP | 06-259034 | * | 9/1994 |
| JP | 2000-305514 | | 11/2000 |
| WO | WO 99/30308 | | 6/1999 |
| WO | WO 02/073581 A2 | | 9/2002 |

* cited by examiner

*Primary Examiner*—Richard Hjerpe
*Assistant Examiner*—Leonid Shapiro
(74) *Attorney, Agent, or Firm*—Ked & Associates, LLP

(57) ABSTRACT

A method and apparatus for driving a plasma display panel that is adaptive for improving a capability of gray scale expression as well as a picture quality. In the method and apparatus, an average brightness of an image is detected. A gray level number of the current image is adjusted in accordance with said average brightness of said image using a pre-stored reference gray level number.

19 Claims, 2 Drawing Sheets

METHOD AND APPARATUS FOR DRIVING PLASMA DISPLAY PANEL

BACKGROUND OF THE INVENTION

1. Field of the Invention

This invention relates to a plasma display panel, and more particularly to a method and apparatus for driving a plasma display panel that is adaptive for improving a capability of gray scale expression as well as a picture quality.

2. Description of the Related Art

Generally, a plasma display panel (PDP) is a display device utilizing a visible light emitted from a phosphorus material when an ultraviolet ray generated by a gas discharge excites the phosphorus material. The PDP has an advantage in that it has a thinner thickness and a lighter weight in comparison to the existent cathode ray tube (CRT) and is capable of realizing a nigh resolution and a large-scale screen.

Such a PDP drives one frame, which is divided into various sub-fields having a different discharge frequency, so as to express gray levels of a picture. Each sub-field is again divided into a reset period for uniformly causing a discharge, an address period for selecting the discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields. Each of the 8 sub-fields is divided into an address period and a sustain period. Herein, the reset period and the address period of each sub-field are equal every sub-field, whereas the sustain period are increased at a ratio of $2^n$ (wherein n=0, 1, 2, 3, 4, 5, 6 and 7) at each sub-field. Since each sub-field has a different sustain period, it is able to express a gray scale of a picture.

However, since the PDP has brightness determined in accordance with the number of sustain pulses, it has problems of picture quality deterioration, power waste and panel damage, etc. when total sustain pulse number in the case of having a high average brightness is equal to that in the case of having a low average brightness If total sustain pulse number is set lowly with respect to all input images, then a contrast is reduced. On the other hand, if total sustain pulse number is set highly with respect to all input images, then the PDP has advantages in that a brightness is high and a contrast is high even in the case of a dark image, but has problems in that a power waste may be increased and a panel may be damaged due to an increase in the temperature of panel. Accordingly, it is necessary to adjust total sustain pulse number appropriately in accordance with an average brightness of an input image.

When the number of sustain pulses corresponding to one gray level interval has a lowest value, that is, '1', the PDP has a higher gray scale expression capability because a gray level expression for an image felt by a human eye becomes closest to a real gray level of an input image, and has an excellent picture quality because an error diffusion artifact is almost not observed by a human eye.

There has been developed a driving scheme of adjusting total sustain pulse number in accordance with an average brightness of an input image, hereinafter referred to as "sustain pulse number control scheme". Such a conventional sustain pulse number control scheme decreases total sustain pulse number at a place having a high average brightness of an input image, to thereby reduce power consumption and prevent panel damages. On the other hand, the conventional sustain pulse control scheme increases total sustain pulse number when an average brightness of an input image is low, and enhances a contrast at a dark screen.

However, in the conventional sustain pulse control scheme, total sustain pulse number may be adjusted without an increase in total gray level number in accordance with an average brightness of an input image. Thus, there is raised following problems. When the number of sustain pulses only is adjusted without an increase in total gray level number, the number of sustain pulses corresponding to one gray level interval becomes considerably large at a dark image. For instance, if total sustain pulse number is adjusted to '768' when total gray level number is '256' in the conventional sustain pulse control scheme, then the number of sustain pulses corresponding to one gray level interval becomes '3'. Since three sustain pulses cause a sustain discharge three times in one gray level interval, a real gray level interval felt by an observer's eye at a dark screen becomes considerably large.

Meanwhile, the PDP has been used a multitoning technique such as an error diffusion or an ordered dithering in order to enhance a gray scale expression capability. In the case of carrying out an error diffusion, an artifact generated at an smooth area, for example, the background area due to an error component diffused into adjacent cells can be observed by a human eye. Since the multitoning technique has been basically developed for a printer, an application of the multitoning technique to the PDP violates its standard process. More specifically, since a printer has a small pixel size, error components between neighborhood pixels are averaged and hence an artifact is almost not observed by a human eye. On the other hand, since a PDP has a relatively large pixel or cell size, an averaging of error components is not made, but an error diffusion value of each cell is recognized by a human eye in the case of applying the multitoning technique to the PDP, and hence an artifact is prominently observed. Moreover, if total sustain pulse number only is adjusted in accordance with an average brightness of an input image like the conventional sustain pulse number control scheme to thereby increase the number of sustain pulses corresponding to one gray level interval to more than three, then an application of the multitoning technique causes more conspicuous observation of an error diffusion artifact.

In order to overcome such problems, there has been suggested a sustain pulse number control strategy of adjusting total sustain pulse number and, at the same time, determining total gray level number depending upon a difference between the highest brightness value and the average brightness value of an image after searching the brightest value from an input image. This sustain pulse number control strategy increases total gray level number when an average brightness of an image is low and a difference between the average brightness value and the highest brightness value is small, to thereby reduce the number of sustain pulses corresponding to one gray level interval, because an error diffusion artifact is well observed if total gray level number is small and total sustain pulse number is large when an average brightness of an image is low and a difference between the average brightness value and the highest brightness value of an image is large Otherwise, it decreases total gray level number when a difference between the average brightness value and the highest brightness value of an image is large. However, such a sustain pulse number control strategy still emerges an error diffusion artifact at a dark screen. Further, the conventional sustain pulse number control strategy differentiates a sub-field arrangement and an emitting pattern according to the number of gray levels when total gray level is varied in accordance with an average brightness of an input image. This causes an increase in a data capacity stored in a memory when the number of sub-field arrangements and emitting patterns as great as types of total gray level number is required. In addition, the conventional sustain pulse number control strategy has a problem in that a probability of generating a flicker in accordance with the sub-field arrangements and the emitting patterns is large.

SUMMARY OF THE INVENTION

Accordingly, it is an object of the present invention to provide a method and apparatus for driving plasma display panel that is adaptive for improving a gray scale expression capability as well as a picture quality.

In order to achieve these and other objects of the invention, a plasma display panel driving method according to one aspect of the present invention includes the steps of detecting an average brightness of an image; and adjusting a gray level number of the current image in accordance with said average brightness of said image using a pre-stored reference gray level number.

In the method, said step of adjusting the gray level number includes increasing a gray level number of said current image when said average brightness of said image is lowly changed into less than a predetermined reference value.

The method further includes the step of increasing the number of sub-fields in a sub-field arrangement according to a gray level number of said current image when said average brightness of said image is lowly changed into less than a pre-determined reference value.

Herein, the number of sustain pulses for causing a discharge is equal to said gray level number.

A sub-field having a minimum weighting value involved in sub-field arrangements having total gray level number adjusted in accordance with said average brightness includes a single of sustain pulse.

Said reference gray level number is a maximum gray level number having the largest gray level expression range.

A method of driving a plasma display panel according to another aspect of the present invention includes the steps of detecting an average brightness of an image; adjusting a gray level number of the current image in accordance with said average brightness of said image using a pre-stored reference gray level number; calculating a sub-field arrangement having said adjusted gray level number using the sub-field arrangement having said reference gray level number; and calculating an emitting pattern having said adjusted gray level number using the emitting pattern having said reference gray level number.

In the method, said step of adjusting the gray level number includes increasing a gray level number of said current image when said average brightness of said image is lowly changed into less than a pre-determined reference value.

The method further includes the step of increasing the number of sub-fields in a sub-field arrangement according to a gray level number of said current image when said average brightness of said image is lowly changed into less than a pre-determined reference value.

Herein, the number of sustain pulses for causing a discharge is equal to said gray level number.

A sub-field having a minimum weighting value involved in sub-field arrangements having total gray level number adjusted in accordance with said average brightness includes a single of sustain pulse.

Said reference gray level number is a maximum gray level number having the largest gray level expression range.

A sub-field arrangement according to said adjusted current gray level number is calculated by multiplying the sub-field arrangement having said reference gray level number by a value that is obtained by dividing said current gray level number by said reference gray level number.

The method further includes the steps of making a reverse gamma correction of said current image; and making an error diffusion of a data having said adjusted gray level number.

Said step of adjusting the current image includes making a reverse gamma correction of said current image; dividing (said adjusted gray level number−1) by (a gray level number of the current input image−1); multiplying said reverse gamma-corrected data by said divided value; and making an error diffusion of said inverse gamma-corrected data.

Said step of calculating the emitting pattern having said adjusted gray level number includes dividing said reference gray level number by a gray level number of said current image to calculate an emitting pattern selection multiple; and selecting an emitting pattern corresponding to said emitting pattern selection multiple from emitting patterns having said reference gray level number.

A method of driving a plasma display panel according to still another aspect of the present invention includes the steps of converting an input image into a pre-determined reference gray level number; selecting an emitting pattern having said gray level number in accordance with a gray level value of said input image; detecting an average brightness of said input image according to the selected emitting pattern; and selecting the number of sustain pulses divided in accordance with said gray level number depending upon said average brightness and said emitting pattern.

In the method, said reference gray level number is a maximum gray level number having the largest gray level expression range.

The method further includes the steps of making a reverse gamma correction of said current image; and making an error diffusion of a data converted into said reference gray level number.

Said step of converting said input image into said pre-determined reference gray level number includes making a reverse gamma correction of said current image; dividing (said adjusted gray level number−1) by (a gray level number of the current input image−1); and multiplying said reverse gamma-corrected data by said divided value.

A method of driving a plasma display panel according to still another aspect of the present invention includes the steps of adjusting a gray level number of an input image; and controlling each gray level value and the number of sustain pulses for causing a discharge, irrespectively of a variation in said gray level number, such that they are same.

In the method, the number of sustain pulses corresponding to a minimum gray level value irrespectively of said variation in the gray level number is one.

A driving apparatus for a plasma display panel according to still another aspect of the present invention includes an average level detector for detecting an average brightness of an image; and gray level number control means for adjusting a gray level number of the current image in accordance with an average brightness of said image using a pre-stored reference gray level number.

In the driving apparatus, said gray level number control means increases a gray level number of said current image when said average brightness of said image is lowly changed into less than a pre-determined reference value.

The driving apparatus further includes a controller for controlling the number of sustain pulses for causing a discharge such that it is equal to said gray level number.

Said controller controls the number of sustain pulses corresponding to a minimum gray level value to be one irrespectively of a variation in the gray level number.

Herein, said reference gray level number is a maximum gray level number having the largest gray level expression range.

A driving apparatus for a plasma display panel according to still another aspect of the present invention includes an average level detector for detecting an average brightness of an image; gray level number control means for adjusting a gray level number of the current image in accordance with said average brightness of said image using a pre-stored reference gray level number; an emitting pattern selector for calculating an emitting pattern having said adjusted gray level number using the emitting pattern having said reference gray level number; and a controller for storing the number of sustain pulses divided in accordance with said gray level number and for selecting the number of sustain pulses in accordance with said average brightness and said emitting pattern.

In the driving apparatus, said gray level number control means increases a gray level number of said current image when said average brightness of said image is lowly changed into less than a pre-determined reference value.

Herein, the number of sustain pulses is equal to said gray level number.

A sub-field having a minimum weighting value involved in sub-field arrangements having total gray level number adjusted in accordance with said average brightness includes a single of sustain pulse.

Said reference gray level number is a maximum gray level number having the largest gray level expression range.

The driving apparatus further includes a reverse gamma corrector for making a reverse gamma correction of said current image; and an error diffuser for making an error diffusion of a data having said adjusted gray level number.

The driving apparatus further includes a multiplier for multiplying said reverse gamma-corrected data by a value that is obtained by dividing (said adjusted gray level number−1) by (a gray level number of the current input image−1) and thereafter applying the multiplied value to the error diffuser.

The driving apparatus further includes a multiplier for dividing said reference gray level number by a gray level number of said current image to calculate to calculate an emitting pattern selection multiple; and sub-field mapping means for selecting an emitting pattern corresponding to said emitting pattern selection multiple from emitting patterns having said reference gray level number to apply the selected emitting pattern to the controller.

A driving apparatus for a plasma display panel according to still another aspect of the present invention includes a gray level converter for converting an input image into a pre-determined reference gray level; an emitting pattern selector for selecting an emitting pattern having said gray level in accordance with a gray level value of said input image; an average level detector for detecting an average brightness of said selected emitting pattern; and a controller for storing the number of sustain pulses divided in accordance with said gray level number and for selecting the number of sustain pulses in accordance with said average brightness and said emitting pattern.

In the driving apparatus, said reference gray level number is a maximum gray level number having the largest gray level expression range.

The driving apparatus further includes a reverse gamma corrector for making a reverse gamma correction of said input image; and an error diffuser for making an error diffusion of a data converted into said reference gray level number.

The driving apparatus further includes a multiplier for multiplying said reverse gamma-corrected data by a value that is obtained by dividing (said adjusted gray level number−1) by (a gray level number of the current input image−1) and thereafter applying the multiplied value to the error diffuser.

A driving apparatus for a plasma display panel according to still another aspect of the present invention includes gray level number control means for adjusting a gray level number of an input image in accordance with an average brightness; and a controller for controlling the number of sustain pulses for causing a discharge such that it is equal to each gray level value irrespectively of a variation in the gray level number.

In the driving apparatus, said controller controls the number of sustain pulses corresponding to a minimum gray level value to be one irrespectively of a variation in the gray level number.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

In a method and apparatus for driving a PDP according to the present invention, total gray level number and total sustain pulse number are adjusted in accordance with a brightness of a screen and the PDP is driven to satisfy the following conditions:

(i) total sustain pulse is adjusted in accordance with an average brightness of a screen.

(ii) total gray level number is equal to total sustain pulse number.

(iii) a minimum number of the sustain pulse is '1'.

(iv) emitting patterns are calculated in correspondence with all of total gray level numbers by utilizing an emitting pattern having a maximum total gray level number. Herein, the maximum total gray level number means the a gray level number having the largest gray level number value of all of the total gray level numbers selected in accordance with an average brightness.

(v) sub-field arrangement are calculated by utilizing sub-field arrangements having the maximum total gray level number.

Figure 1:
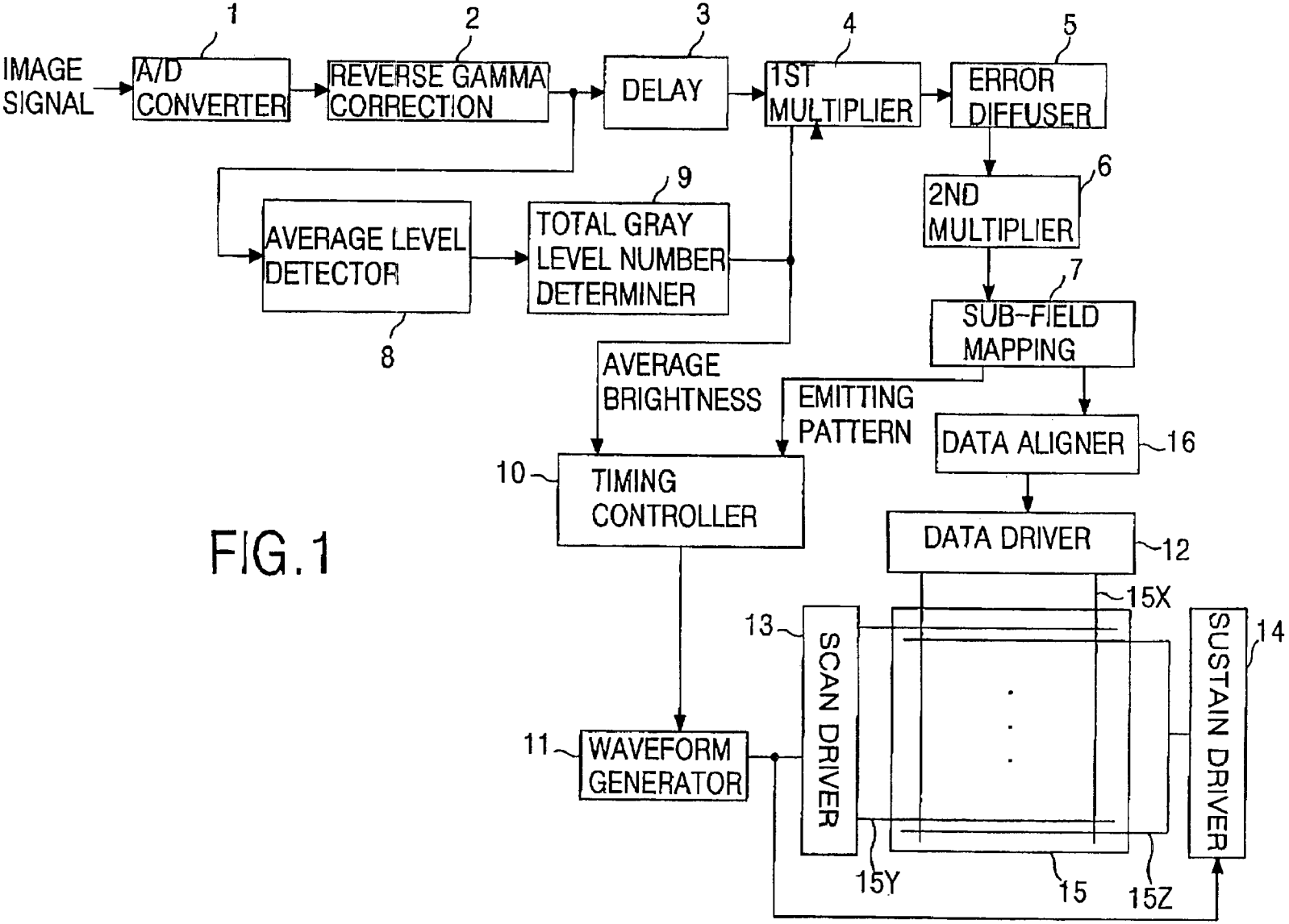
FIG. 1 is a block diagram showing a configuration of a plasma display panel driving apparatus according to an embodiment of the present invention.

Referring to FIG. 1, there is shown a PDP driving apparatus according to a first embodiment of the present invention.

The PDP driving apparatus includes a reverse gamma corrector 2, a delay 3, a first multiplier 4, an error diffuser 5, a second multiplier 6 and a sub-field mapping unit 7 that are connected between an analog to digital converter 1, hereinafter referred to as "A/D converter", and a timing controller 10, and an average level detector 8 and a total gray level determiner 9 that are connected between the corrector 2 and the timing controller 10.

The A/D converter 1 converts red, green and blue analog input image data into digital data to apply them to the inverse gamma corrector 2. The timing controller 10 stores the number of sustain pulses divided in accordance with total gray level number, and outputs the corresponding number of sustain pulses in accordance with an average brightness inputted from the average level detector 8 and an emitting pattern inputted from the sub-field mapping unit 7. The reverse gamma corrector 2 makes a reverse gamma correction of an image signal to linearly convert a brightness according to a gray level value of the image signal. The delay 3 delays the gamma-corrected data by one frame interval (or one field interval) to synchronize an image data inputted to the first multiplier 4 with a total gray level number data. The first multiplier 4 plays a role to convert said total gray level number into a current total gray level number by utilizing an equation (2) as will be mentioned later.

The error diffuser 5 plays a role to diffuse an error component to adjacent cells, thereby finely adjusting a brightness value. To this end, the error diffuser 5 separates a data into a constant number part and a decimal fraction number part and multiplies the decimal fraction part by a Foly-Steinberg coefficient, thereby diffusing an error into adjacent cells. The second multiplier 6 calculates an emitting-pattern selection multiple for selecting an emitting pattern suitable for a current total gray level number within emitting patterns having the maximum total gray level number stored in the sub-field mapping unit 7 by utilizing an equation (3) as will be mentioned later. The sub-field mapping unit 7 selects an emitting pattern corresponding to a data inputted to the second multiplier 6 to apply it to the timing controller 10.

The average level detector 8 calculates an average brightness of one frame data subject to a reverse gamma correction, that is, a data for one field to apply it the total gray level number determiner 9 and the timing controller 10. The total gray level determiner 9 adjusts total gray level number and a sub-field arrangement according to total gray level number in accordance with an average brightness inputted from the average level detector 8. The total gray level number determiner 9 increases total gray level number of a current image when an average brightness of an image has a low value less than a reference value. The maximum total gray level number only is stored in the total gray level number determiner 9. This aims at minimizing a capacity of a data stored in a memory.

A method of calculating a sub-field arrangement at a smaller total gray level number than the maximum total gray level number will be described below.

A sub-field arrangement at a current gray level number determined by the total gray level number determiner 9 is calculated by a value in which a value dividing the current total gray level number by the maximum total gray level number, that is, a factor A is multiplied by a sub-field arrangement having the maximum total gray level number as indicated in the following equation:

$$\text{FactorA}=\text{Current Total Gray Level Number}/\text{Maximum Total Gray Level Number} \quad (1)$$

For example, assuming that a maximum total gray level number and a sub-field arrangement according to the maximum total gray level number are '1024' and [1 2 4 8 16 32 64 128 128 128 128 128 128 128], a sub-field arrangement at a current gray level number '256' is determined to be [0 0 1 2 4 8 16 32 32 32 32 32 32 32] by multiplying each brightness weighting value of a sub-field arrangement at the maximum total gray level number by 256/1024=0.25. Herein, the first and second sub-field arrangements, of sub-field arrangements at a current gray level number '256', are calculated into '0.25' and '0.5', respectively, but are replaced by '0'.

When a sub-field arrangement for a current gray level number smaller than the maximum total gray level number '1024' and a brightness weighting value according to that sub-field arrangement are calculated in this manner, the calculated results are as described in the following table:

TABLE 1

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 1024 | 1 | 2 | 4 | 8 | 16 | 32 | 64 | 128 | 128 | 128 | 128 | 128 | 128 | 128 |
| 896 | 1 | 2 | 3 | 7 | 14 | 28 | 56 | 112 | 112 | 112 | 112 | 112 | 112 | 112 |
| 768 | 1 | 1 | 3 | 6 | 12 | 24 | 48 | 96 | 96 | 96 | 96 | 96 | 96 | 96 |
| 640 | 1 | 1 | 2 | 5 | 10 | 20 | 40 | 80 | 80 | 80 | 80 | 80 | 80 | 80 |
| 512 | 0 | 1 | 2 | 4 | 8 | 16 | 32 | 64 | 64 | 64 | 64 | 64 | 64 | 64 |
| 384 | 0 | 1 | 1 | 3 | 6 | 12 | 24 | 48 | 48 | 48 | 48 | 48 | 48 | 48 |
| 256 | 0 | 0 | 1 | 2 | 4 | 8 | 16 | 32 | 32 | 32 | 32 | 32 | 32 | 32 |

In the above Table 1, the leftmost column represents total gray level number and the uppermost law represents a sequence of sub-fields. Each brightness weighting value of a sub-field arrangement according to total gray level number is equal to the number of sustain pulses As can be seen from Table 1, the PDP driving method and apparatus according to the embodiment of the present invention satisfies the above-mentioned driving conditions (i), (ii), (iii) and (v). Thus, the minimum brightness weighting value of all the sub-field arrangements becomes '1'.

The number of sustain pulses indicated in the above Table 1 is stored in the timing controller 10.

In the mean time, an emitting pattern for indicating a gray level value '7' at total gray level number '256' and the number of sustain pulses according to that emitting pattern are described in the following table:

TABLE 2

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 256 Emitting Pattern | 0 ○ | 0 ○ | 1 ○ | 2 ○ | 4 ○ | 8 x | 16 x | 32 x | 32 x | 32 x | 32 x | 32 x | 32 x | 32 x |

In the above Table 2, '○' represents turned-on sub-fields while '×' does turned-off sub-fields.

As can be seen from the above Table 2, the number of sustain pulses for indicating a gray level value '7' is '7'.

A multiplication factor B multiplied with respect to a reverse gamma-corrected data by the first multiplier 4 is expressed as the following equation:

$$\text{FactorB}=\text{Current Total Gray Level Number}-1/\text{Total Gray Level Number of Input Image}-1 \quad (2)$$

Assuming that total gray level number of an input image should be '256' and total gray level number determined by the total gray level number determiner 9 in accordance with an average brightness should be '1024', a multiplication factor in the first multiplier 4 is 1023/255≈4. Thus, when total gray level number of a reverse gamma-corrected data inputted to the first multiplier 4 is '255', the reverse gamma-corrected data is converted into a current total gray level number '1023' by the first multiplier 4.

A data passing the first multiplier 4 is error-diffused and then is inputted to the second multiplier 6. The second multiplier 6 calculates an emitting pattern selection multiple with the aid of the error-diffused data.

An emitting pattern having the maximum total gray level number only is stored in the sub-field mapping unit 7, and an emitting pattern suitable for a current total gray level number is selected within emitting patterns having the maximum total gray level number depending upon an emitting pattern selection multiple inputted from the second multiplier 6 Thus, such a method of selecting an emitting pattern satisfies the above-mentioned condition (iv).

Assuming that the maximum total gray level number should be '1024' and a current total gray level number subject to an error diffusion should be '512', an emitting pattern selection multiple calculated by the second multiplier 6 becomes 1024/512=2. Thus, when an emitting pattern selection multiple '2' calculated by the second multiplier 6 is inputted to the sub-field mapping unit 7, the sub-field mapping unit 7 calculates an emitting pattern having a current total gray level number from an emitting pattern having the maximum total gray level number. For example, if the above-mentioned emitting pattern selection multiple '2' is inputted to the sub-field mapping unit 7, then emitting patterns corresponding to a multiple of 2 are selected from emitting patterns having the maximum total gray level number '1024' as indicated in the following tables:

TABLE 3

| Gray Level | Emitting Pattern |
|---|---|
| 0 | xxxxxxxxxxxxxx |
| 1 | ○xxxxxxxxxxxxx |
| 2 | x○xxxxxxxxxxxx |
| 3 | ○○xxxxxxxxxxxx |
| 4 | xx○xxxxxxxxxxx |
| 5 | ○x○xxxxxxxxxxx |
| 6 | x○○xxxxxxxxxxx |
| 7 | ○○○xxxxxxxxxxx |
| 8 | xxx○xxxxxxxxxx |
| 9 | ○xx○xxxxxxxxxx |
| 10 | x○x○xxxxxxxxxx |
| 11 | ○○x○xxxxxxxxxx |
| 12 | xx○○xxxxxxxxxx |
| 13 | ○x○○xxxxxxxxxx |
| 14 | x○○○xxxxxxxxxx |
| 15 | ○○○○xxxxxxxxxx |
| 16 | xxxx○xxxxxxxxx |

TABLE 4

| | 1 | 2 | 4 | 8 | 16 | 32 | 64 | 128 | 128 | 128 | 128 | 128 | 128 | 128 |
|---|---|---|---|---|---|---|---|---|---|---|---|---|---|---|
| 0 | x | x | x | x | x | x | x | x | x | x | x | x | x | x |
| 1 | ○ | x | x | x | x | x | x | x | x | x | x | x | x | x |
| 2 | x | ○ | x | x | x | x | x | x | x | x | x | x | x | x |
| 3 | ○ | ○ | x | x | x | x | x | x | x | x | x | x | x | x |
| 4 | x | x | ○ | x | x | x | x | x | x | x | x | x | x | x |
| 5 | ○ | x | ○ | x | x | x | x | x | x | x | x | x | x | x |
| 6 | x | ○ | ○ | x | x | x | x | x | x | x | x | x | x | x |
| 7 | ○ | ○ | ○ | x | x | x | x | x | x | x | x | x | x | x |
| 8 | x | x | x | ○ | x | x | x | x | x | x | x | x | x | x |
| 9 | ○ | x | x | ○ | x | x | x | x | x | x | x | x | x | x |
| 10 | x | ○ | x | ○ | x | x | x | x | x | x | x | x | x | x |
| 11 | ○ | ○ | x | ○ | x | x | x | x | x | x | x | x | x | x |
| 12 | x | x | ○ | ○ | x | x | x | x | x | x | x | x | x | x |
| 13 | ○ | x | ○ | ○ | x | x | x | x | x | x | x | x | x | x |
| 14 | x | ○ | ○ | ○ | x | x | x | x | x | x | x | x | x | x |
| 15 | ○ | ○ | ○ | ○ | x | x | x | x | x | x | x | x | x | x |
| 16 | x | x | x | x | ○ | x | x | x | x | x | x | x | x | x |

An emitting pattern selection multiple calculated by the second multiplier 6 is obtained by the following equation:

$$\text{Factor3}=\text{Maximum Total Gray Level Number}/\text{Current Total Gray Level Number} \quad (3)$$

The above Table 3 represents emitting patterns at each gray level in a range of 0 to 16 when the maximum total gray level number is '1024', and the above Table 4 represents brightness weighting values of each sub-field at an emitting pattern having the maximum total gray level number. Herein, the brightness weighting values is equal to the number of sustain pulses.

An emitting pattern having a total gray level number '512' selected by an emitting pattern selection multiple '2' is selected only from emitting patterns corresponding to a multiple of 2 of an emitting pattern having the maximum total gray level number '1024' as can be seen from the following tables:

TABLE 5

| 1024 | 512 | Emitting Pattern |
|---|---|---|
| 0 | 0 | xxxxxxxxxxxxxx |
| 2 | 1 | x○xxxxxxxxxxxx |
| 4 | 2 | xx○xxxxxxxxxxx |
| 6 | 3 | x○○xxxxxxxxxxx |
| 8 | 4 | xxx○xxxxxxxxxx |
| 10 | 5 | x○x○xxxxxxxxxx |
| 12 | 6 | xx○○xxxxxxxxxx |
| 14 | 7 | x○○○xxxxxxxxxx |
| 16 | 8 | xxxx○xxxxxxxxx |

TABLE 6

| | 0 | 1 | 2 | 4 | 8 | 16 | 32 | 64 | 64 | 64 | 64 | 64 | 64 | 64 |
|---|---|---|---|---|---|---|---|---|---|---|---|---|---|---|
| 0 | x | x | x | x | x | x | x | x | x | x | x | x | x | x |
| 1 | x | ○ | x | x | x | x | x | x | x | x | x | x | x | x |
| 2 | x | x | ○ | x | x | x | x | x | x | x | x | x | x | x |
| 3 | x | ○ | ○ | x | x | x | x | x | x | x | x | x | x | x |
| 4 | x | x | x | ○ | x | x | x | x | x | x | x | x | x | x |
| 5 | x | ○ | x | ○ | x | x | x | x | x | x | x | x | x | x |
| 6 | x | x | ○ | ○ | x | x | x | x | x | x | x | x | x | x |
| 7 | x | ○ | ○ | ○ | x | x | x | x | x | x | x | x | x | x |
| 8 | x | x | x | x | ○ | x | x | x | x | x | x | x | x | x |

The above Table 5 represents an emitting pattern having total gray level number '512' selected by a multiple of 2 from the maximum total gray level number as indicated in the above Tables 3 and 4, and the above Table 6 represents brightness weighting values of each sub-field at an emitting pattern having total gray level number '512' as indicated in Table 5. Herein, the weighting value is equal to the number of sustain pulses.

A weighting value, that is, the number of sustain pulses in Table 6 is equal to that in Table 1. Accordingly, even when total gray level number is changed, the number of sustain pulses corresponding to one gray level interval always becomes '1'.

When a current total gray level number is '256', an emitting pattern selection multiple obtained by the above equation (3) becomes '4'. Accordingly, an emitting pattern having total gray level number '256' selected by the sub-field mapping unit 7 is selected only from emitting patterns corresponding to a multiple of 4 of an emitting pattern having the maximum total gray level number '1024' as can be seen from the following tables:

TABLE 7

| 1024 | 256 | Emitting Pattern |
|---|---|---|
| 0 | 0 | xxxxxxxxxxxxxx |
| 4 | 1 | xx○xxxxxxxxxxx |
| 8 | 2 | xxx○xxxxxxxxxx |
| 12 | 3 | xx○○xxxxxxxxxx |
| 16 | 4 | xxxx○xxxxxxxxx |

TABLE 8

| | 0 | 0 | 1 | 2 | 4 | 8 | 16 | 32 | 32 | 32 | 32 | 32 | 32 | 32 |
|---|---|---|---|---|---|---|---|---|---|---|---|---|---|---|
| 0 | x | x | x | x | x | x | x | x | x | x | x | x | x | x |
| 1 | x | x | ○ | x | x | x | x | x | x | x | x | x | x | x |
| 2 | x | x | x | ○ | x | x | x | x | x | x | x | x | x | x |
| 3 | x | x | ○ | ○ | x | x | x | x | x | x | x | x | x | x |
| 4 | x | x | x | x | ○ | x | x | x | x | x | x | x | x | x |

The above Table 7 represents an emitting pattern having total gray level number '256' selected by a multiple of 4 from the maximum total gray level number as indicated in the above Tables 3 and 4, and the above Table 8 represents brightness weighting values of each sub-field at an emitting pattern having total gray level number '256' as indicated in Table 5. Herein, the weighting value is equal to the number of sustain pulses.

Meanwhile, if an emitting pattern selection multiple is calculated into a decimal fraction number in the above equation (3), then an error may occur. Due to this error, the number of sustain pulses corresponding to one gray level interval can be more than '1'. Accordingly, when a decimal fraction number is generated from the above equation (3), the number of sustain pulses corresponding to one gray level interval is replaced by a constant number close to the calculated decimal fraction number such that it always becomes '1'.

The timing controller 10 selects the number of sustain pulses in Table 1 corresponding to current total gray level number and gray level value depending upon the selected emitting pattern and the average brightness. As a result, the PDP driving method and apparatus according to the present invention determines total gray level number and the number of sustain pulses depending upon an average brightness, and converts total gray level number into a current total gray level number with the aid of the above equation (2) and then selects an emitting pattern having the current total gray level number within emitting patterns having the maximum total gray level number with the aid of the second multiplier 6 or the equation (3).

The PDP driving apparatus according to the first embodiment of the present invention includes a PDP 15, a data driver 12 for driving data electrodes of the PDP 15, a scan driver 13 for driving scan electrodes of the PDP 15, a sustain driver 14 for driving sustain electrodes of the PDP 15, a data aligner 16 connected between the data driver 12 and the sub-field mapping unit 7, and a waveform generator 11 connected between the timing controller 11 and the scan/sustain drivers 13 and 14.

The PDP 15 is provided with scan electrodes 15Y and sustain electrodes 15Z for causing a surface discharge type of sustain discharge in accordance with a sustaining pulse. Further, the PDP 15 is provided with data electrodes 15X perpendicularly crossing the scan electrodes 15Y and the sustain electrodes 15Z to cause an address discharge along with the scan electrodes 15Y. An inactive mixture gas, such as He+Xe, Ne+Xe or He+Xe+Ne, is injected into a discharge space between an upper substrate and a lower substrate of the PDP 15.

The data driver 12 applies a data from the data aligner 16 to the data electrodes 15X of the PDP 15 every scan period, that is, every horizontal synchronizing interval. The scan driver 13 applies an initialization waveform such as a reset waveform or a setup waveform in the reset period or the setup period to all the scan electrodes 15Y simultaneously to initialize the entire field, and then sequentially applies a scanning pulse to the scan electrodes 15Y such that it is synchronized with a data pulse to select a scan line. Further, the scan driver 13 applies a sustain pulse to the scan electrodes 15Y simultaneously under control of the waveform generator 11 to thereby cause a sustain discharge.

The data aligner 16 re-aligns a data from the sub-field mapping unit 10 for each drive integrated circuit (D-IC) of the data driver 16. The waveform generator 11 controls the scan driver 13 and the sustain driver 14 in accordance with the number of sustain pulses inputted from the timing controller 10, thereby allowing the scan driver 13 and the sustain driver 14 to generate a sustaining pulse. Further, the waveform generator 11 applies a timing control signal to the scan driver 13 and the sustain driver 14 under control of the timing controller 10, thereby allowing the scan driver 13 to generate an initialization waveform and a voltage required for the address period.

Figure 2:
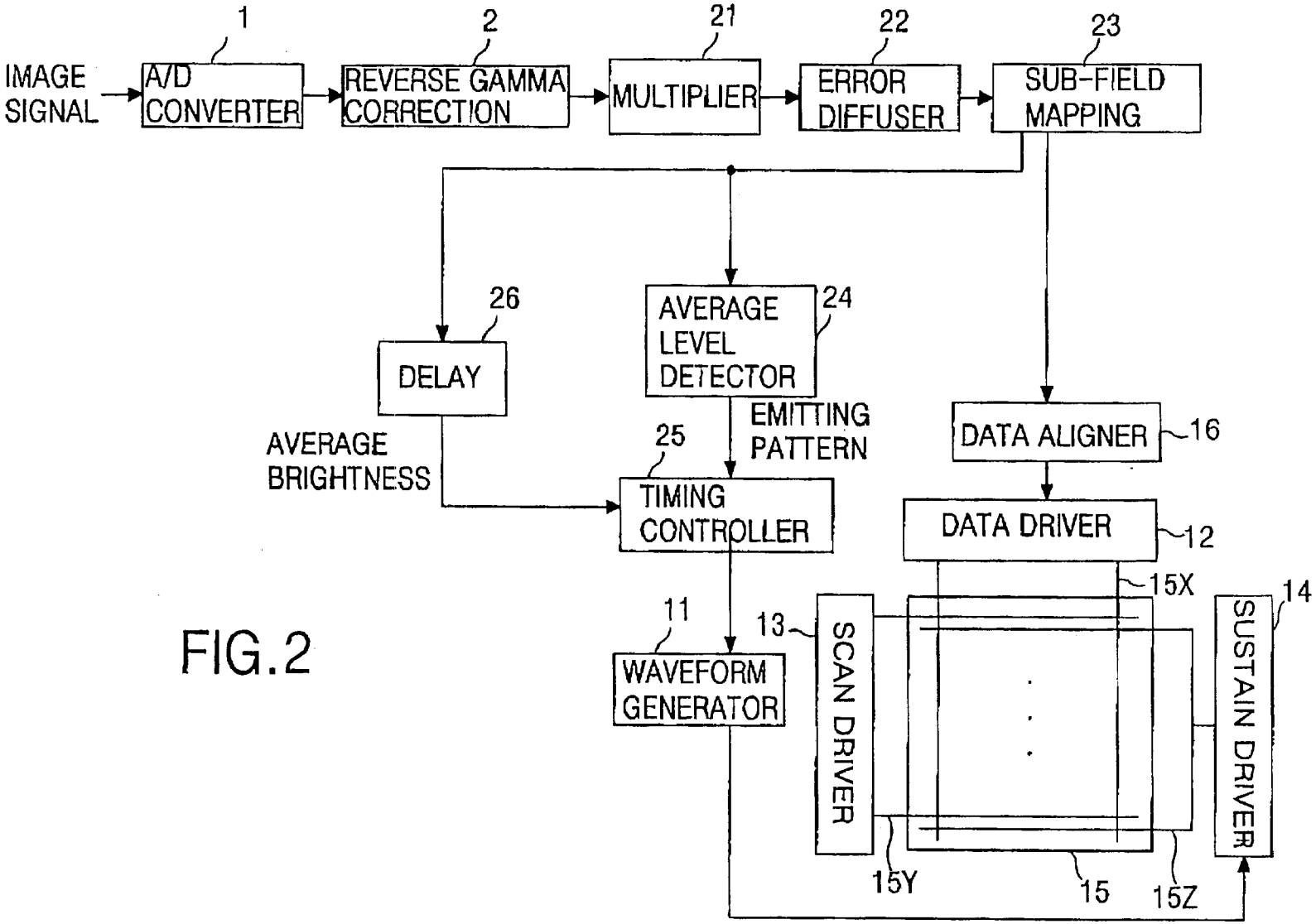
FIG. 2 is a block diagram showing a configuration of a plasma display panel driving apparatus according to another embodiment of the present invention.

Referring to FIG. 2, there is shown a PDP driving apparatus according to a second embodiment of the present invention.

Since an A/D converter, an reverse gamma corrector, a PDP, a data driver, a scan driver, a sustain driver, a data alinger and a waveform generator in FIG. 2 are identical to those in FIG. 1, they will be labeled with the same reference numerals as those in FIG. 1 and a detailed explanation as to them will be omitted.

The PDP driving apparatus according to the second embodiment of the present invention includes a reverse gamma corrector 2, a multiplier 21, an error diffuser 22, a sub-field mapping unit 23 and an average level detector 24 that are connected between an A/D converter 1 and a timing controller 25, and a delay 21 connected between the sub-field mapping unit 23 and the timing controller 25.

The timing controller 25 is stored with the number of sustaining pulses divided in accordance with total gray level number determined by an average brightness like Table 1, and outputs the corresponding number of sustain pulses in accordance with an average brightness inputted from the average level detector 24 and an emitting pattern inputted from the delay 26. The multiplier 21 multiplies a reverse gamma-corrected data by a multiplication factor B calculated with the aid of the following equation, thereby converting total gray level number of the reverse gamma-corrected data into the maximum total gray level number.

$$\text{FactorB}=\text{Maximum Total Gray Level Number}-1/\text{Total Gray Level Number of Input Image}-1 \quad (4)$$

Assuming that total gray level number of an input image should be '256' and the maximum total gray level number should be '1024', a multiplication factor in the multiplier 21 is 1023/255≈4. Thus, when total gray level number of a reverse gamma-corrected data inputted to the multiplier 21 is '256', the reverse gamma-corrected data is converted into the maximum total gray level '1024' by means of the multiplier 22.

A data passing the multiplier 21 is error-diffused by the error diffuser 22, and then is mapped onto each sub-field in accordance with a gray level value by means of the sub-field mapping unit 23. The sub-field mapping unit 23 selects an emitting pattern according to a gray level value of the error-diffused data to apply it to the average level detector 24 and the delay 26.

The average level detector 24 calculates an average brightness of one frame data, that is, a data for one field subject to a reverse gamma correction to thereby apply it to the timing controller 25. The delay 26 delays the emitting pattern by one frame interval or one field interval for the purpose of synchronizing an emitting pattern inputted to the timing controller 25 with the average brightness.

As a result, the PDP driving apparatus according to the second embodiment of the present invention fixes total gray level number of a data inputted to the timing controller 25 into the maximum total gray level number with the aid of the multiplier 21 and adjusts the number of sustain pulses set for the emitting pattern as indicated in Table 1 depending upon total gray level number adjusted in accordance with an average brightness. The PDP driving apparatus according to the second embodiment satisfies the conditions (i), (iii), (iv) and (v) other than the conditions (ii).

The PDP driving method and apparatus according to the present invention has more excellent advantages than the conventional sustain pulse number control strategy in respect of a flicker, a hardware configuration, an error diffusion artifact, a gray scale expression capability and a contour noise or a false contour, etc.

More specifically, a flicker means that a brightness of the screen is unnaturally changed due to a sub-field arrangement and an emitting pattern changed in accordance with a brightness of an image. In view of such a flicker, the conventional sustain pulse number control strategy can not choice but to generate a flicker because, as total gray level number is varied in accordance with a screen brightness, the sub-field arrangement and the emitting pattern is changed.

The PDP driving method and apparatus uses only a sub-field arrangement and an emitting pattern having the maximum total gray level number. As can be seen from the following table 9, the sub-field arrangement and the emitting pattern having total gray level number other than the maximum total gray level number. This differentiates the number of sustain pulses, but allows a basic shape of the emitting pattern to be identical to the sub-field arrangement and the emitting pattern having the maximum gray level number to thereby minimize a flicker.

TABLE 9

| Total Gray Level Number | Conversion Value | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| 1024 | 512 | 1 | 2 | 4 | 8 | 16 | 32 | 64 | 128 | 128 | 128 | 128 | 128 | 128 | 128 |
| Emitting Pattern | | ○ | ○ | ○ | ○ | ○ | ○ | ○ | ○ | ○ | ○ | x | x | x | x |
| 768 | 384 | 1 | 1 | 3 | 6 | 12 | 24 | 48 | 96 | 96 | 96 | 96 | 96 | 96 | 96 |
| Emitting Pattern | | ○ | ○ | ○ | ○ | ○ | ○ | ○ | ○ | ○ | ○ | x | x | x | x |
| 512 | 256 | 0 | 1 | 2 | 4 | 8 | 16 | 32 | 64 | 64 | 64 | 64 | 64 | 64 | 64 |

TABLE 9-continued

| Total Gray Level Number | Conversion Value | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| | Emitting Pattern | ○ | ○ | ○ | ○ | ○ | ○ | ○ | ○ | ○ | ○ | x | x | x | x |
| 384 | 192 | 0 | 1 | 1 | 3 | 6 | 12 | 24 | 48 | 48 | 48 | 48 | 48 | 48 | 48 |
| | Emitting Pattern | ○ | ○ | ○ | ○ | ○ | ○ | ○ | ○ | ○ | ○ | x | x | x | x |
| 256 | 128 | 0 | 0 | 1 | 2 | 4 | 8 | 16 | 32 | 32 | 32 | 32 | 32 | 32 | 32 |
| | Emitting Pattern | ○ | ○ | ○ | ○ | ○ | ○ | ○ | ○ | ○ | ○ | x | x | x | x |
| 370 | 185 | 0 | 1 | 1 | 3 | 6 | 12 | 24 | 48 | 48 | 48 | 48 | 48 | 48 | 48 |
| | Emitting Pattern | ○ | ○ | ○ | ○ | ○ | ○ | ○ | ○ | ○ | ○ | x | x | x | x |

The above Table 9 represents emitting patterns when total gray level number of an input image is '256' and a gray level value of an input image is '128' and the number of sustain pulses adjusted in accordance with a conversion value according to the emitting pattern. In Table 9, a value corresponding to a gray level '128' of an input image when total gray level is '370', and a gray level value '184' really selected due to this error. Such an error may occur a decimal fraction number calculated upon conversion of the sub-field arrangement having total gray level, but a flicker does almost not appear because of the same emitting pattern as other total gray level number in spite of an error in the selected value. Furthermore, the PDP driving method and apparatus according to the present invention allows the emitting pattern to be always identical after conversion of total gray level number. In other words, the sub-field arrangement is changed in accordance with total gray level number, but the emitting patterns are always same because they are selected within emitting patterns having the maximum total gray level. Since the same emitting pattern is used with respect to a gray level of the same image, a light intensity is changed, but a light distribution on a time basis is not changed. Accordingly, an unnatural brightness variation does not occur upon transition of the screen, so that an observer does almost not feel a flicker.

The PDP driving method and apparatus will be compared with the conventional sustain pulse number control strategy in respect of a hardware configuration below.

The conventional sustain pulse number control strategy detects a peak level of an image to determine total gray level number and total sustain pulse number. Furthermore, the conventional sustain pulse number control strategy must store a plurality of sub-field arrangements and a plurality of emitting patterns according to total gray level number. On the other hand, the PDP driving method and apparatus according to the present invention selects an emitting pattern within emitting patterns having the maximum total gray level number and determines a sub-field arrangement using the sub-field arrangement having the maximum total gray level number Accordingly, the PDP driving method and apparatus according to the present invention allows a memory capacity to be dramatically reduced in comparison to the conventional sustain pulse number control strategy. Furthermore, the PDP driving method and apparatus according to the present invention does not require peak level detecting means because total gray level number is always equal to total sustain pulse number irrespectively of a peak level of an image, so that it permits a hardware configuration to be more simplified to thereby reduce a cost according to the hardware configuration.

The PDP driving method and apparatus will be compared with the conventional sustain pulse number control strategy in respect of an error diffusion artifact below.

The conventional sustain pulse number control strategy allows total gray level number to be analogous to total sustain pulse number only when an average brightness of an image is low and a peak level of an image is low, and increases the number of sustain pulses. Furthermore, the conventional sustain pulse number strategy increases only total sustain pulse number without adjusting total gray level number when a peak level of an image is high. Accordingly, the conventional sustain pulse number control strategy adjusts only total sustain pulse number to prominently emerge an error diffusion artifact because the number of sustain pulses corresponding to one gray level interval is more than three. On the other hand, the PDP driving method and apparatus allows total gray level number to be enlarged at a dark image and allows total gray level number to be always equal to total sustain pulse number, so that the number of sustain pulses corresponding to one gray level interval becomes a minimum number '1'. Thus, a gray level expression becomes natural and an error diffusion artifact does almost not appear.

The PDP driving method and apparatus will be compared with the conventional sustain pulse number control strategy in respect of a gray level expression capability below.

The conventional sustain pulse number control strategy has deteriorates a gray level expression capability because a really used gray level number is not large even though total gray level number is large. For instance, the conventional sustain pulse control strategy can select and use only 256 gray levels even though total gray level number is '512', but can not express 128 gray levels when the used gray level number is '256' and the number of total sustain pulses is '384'. On the other hand, the PDP driving method and apparatus according to the present invention can always assure a linearity in a gray level expression and has a large gray level expression range because total gray level number is changed in accordance with an average brightness of an image and total gray level number is always equal to the number of sustain pulses.

The PDP driving method and apparatus will be compared with the conventional sustain pulse number control strategy in respect of a contour noise below.

Generally, a contour noise is liable to occur when the number of sustain pulses is small and a moving picture is displayed on a dark screen of the PDP. The PDP driving method and apparatus according to the present invention has a smaller contour noise than the conventional sustain pulse number control strategy when the largest sub-field number is same.

As described above, according to the present invention, a hardware configuration is more simplified, to thereby reduce a cost, than the conventional PDP driving scheme. Furthermore, factors deteriorating a picture quality such as a flicker, an error diffusion artifact and a contour noise, etc and a gray level expression capability is enhanced, thereby improving a picture display quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising:

detecting an average brightness of an image;

adjusting a gray level number of the current image in accordance with said average brightness of said image using a pre-stored reference gray level number;

calculating a sub-field arrangement having said adjusted gray level number using the sub-field arrangement having said reference gray level number; and calculating an emitting pattern having said adjusted gray level number using the emitting pattern having said reference gray level number, wherein adjusting the gray level number of the current image further includes:

performing reverse gamma correction of said current image;

dividing (said adjusted gray level number−1) by (a gray level number of the current input image−1);

multiplying said reverse gamma-corrected data by said divided value; and performing error diffusion of said inverse gamma-corrected data.

2. The method as claimed in claim 1, wherein said step of adjusting the gray level number includes:

increasing a gray level number of said current image when said average brightness of said image is lowly changed into less than a pre-determined reference value.

3. The method as claimed in claim 1, further comprising increasing the number of sub-fields in a sub-field arrangement according to a gray level number of said current image when said average brightness of said image is less than a pre-determined reference value.

4. The method as claimed in claim 1, wherein the number of sustain impulses for causing a discharge is equal to said gray level number.

5. The method as claimed in claim 1, wherein a sub-field having a minimum weighting value involved in sub-field arrangements having total gray level number adjusted in accordance with said average brightness includes a single of sustain pulse.

6. The method as claimed in claim 1, wherein said reference gray level number is a maximum gray level number having the largest gray level expression range.

7. The method as claimed in claim 1, wherein a sub-field arrangement according to said adjusted current gray level number is calculated by multiplying the sub-field arrangement having said reference gray level number by a value that is obtained by dividing said current gray level number of said reference gray level number.

8. The method as claimed in claim 1, further comprising the steps of:

making a reverse gamma correction of said current image; and making an error diffusion of a data having said adjusted gray level number.

9. The method as claimed in claim 1, wherein said step of calculating the emitting pattern having said adjusted gray level number includes:

dividing said reference gray level number by a gray level number of said current image to calculate an emitting pattern selection multiple; and selecting an emitting pattern corresponding to said emitting pattern selection multiple from emitting patterns having said reference gray level number.

10. A method of driving a plasma display panel, comprising:

converting an input image into a pre-determined reference gray level number;

selecting an emitting pattern having said gray level number in accordance with a gray level value of said input image;

detecting an average brightness of said input image according to the selected emitting pattern; and selecting a number of sustain pulses divided in accordance with said gray level number depending upon said average brightness and said emitting pattern, wherein converting the input image includes:

performing reverse gamma correction of said current image;

dividing (said adjusted gray level number−1) by (a gray level number of the input image−1);

multiplying said reverse gamma-corrected data by said divided value; and performing error diffusion of said reverse gamma-corrected data multiplied by said divided value.

11. The method as claimed in claim 10, wherein said reference gray level number is a maximum gray level number having the largest gray level expression range.

12. A driving apparatus for a plasma display panel, comprising:

an average level detector for detecting an average brightness of an image;

gray level number control means for adjusting a gray level number of the current image in accordance with said average brightness of said image using a pre-stored reference gray level number;

an emitting pattern selector for calculating an emitting pattern having said adjusted gray level number using the emitting pattern having said reference gray level number; and a controller for storing the number of sustain pulses divided in accordance with said gray level number and for selecting the number of sustain pulses in accordance with said average brightness and said emitting pattern, the driving apparatus further comprising:

a reverse gamma corrector for making a reverse gamma correction of said current image;

an error diffuser for making an error diffusion of a data having said adjusted gray level number, and a multiplier for multiplying said reverse gamma-corrected data by a value that is obtained by dividing (said adjusted gray level number−1) by (a gray level number of the current input image−1) and thereafter applying the multiplied value to the error diffuser.

13. The driving apparatus as claimed in claim 12, wherein said gray level number control means increases a gray level number of said current image when said average brightness if said image is lowly changed into less than a pre-determined reference value.

14. The driving apparatus as claimed in claim 12, wherein the number of sustain pulses is equal to said gray level number.

15. The driving apparatus as claimed in claim 12, wherein a sub-field having a minimum weighting value involved in sub-field arrangements having total gray level number adjusted in accordance with said average brightness includes a single of sustain pulse.

16. The driving apparatus as claimed in claim 12, wherein said reference gray level number is a maximum gray level number having the largest gray level expression range.

17. The driving apparatus as claimed in claim 12, further comprising:

a multiplier for dividing said reference gray level number by a gray level number of said current image to calculate an emitting pattern selection multiple; and sub-field mapping means for selecting an emitting pattern corresponding to said emitting pattern selection multiple from emitting patterns having said reference gray level number to apply the selected emitting pattern to the controller.

18. A driving apparatus for a plasma display panel, comprising:

a gray level converter for converting an input image into a pre-determined reference gray level;

an emitting pattern selector for selecting an emitting pattern having said gray level in accordance with a gray level value of said input image;

an average level detector for detecting an average brightness of said selected emitting pattern;

a controller for storing a number of sustain pulses divided in accordance with said gray level number and for selecting the number of sustain pulses in accordance with said average brightness and said emitting pattern;

a reverse gamma corrector for making a reverse gamma correction of said input image;

an error diffuser for making an error diffusion of a data converted into said reference gray level number; and a multiplier for multiplying said reverse gamma-corrected data by a value that is obtained by dividing (said adjusted gray level number−1) by (a gray level number of the current input image−1) and thereafter applying the multiplied value to the error diffuser.

19. The driving apparatus as claimed in claim 18, wherein said reference gray level number is a maximum gray level number having the largest gray level expression range.

* * * * *